US008393311B2

(12) United States Patent
Steiner et al.

(10) Patent No.: US 8,393,311 B2
(45) Date of Patent: Mar. 12, 2013

(54) INTERNAL COMBUSTION ENGINE WITH DRY SUMP LUBRICATION

(75) Inventors: Bernd Steiner, Bergisch Gladbach (DE); Johannes Mehring, Cologne (DE); Helmut Hans Ruhland, Eschweiler (DE); Klaus Moritz Springer, Hagen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 551 days.

(21) Appl. No.: 12/700,031

(22) Filed: Feb. 4, 2010

(65) Prior Publication Data

US 2010/0199941 A1 Aug. 12, 2010

(30) Foreign Application Priority Data

Feb. 6, 2009 (DE) ..... 10 2009 000 657

(51) Int. Cl.
*F01M 5/00* (2006.01)

(52) U.S. Cl. ..... 123/196 AB; 123/196 CP; 123/196 R; 184/104.1

(58) Field of Classification Search ..... 123/1 R, 123/1 A, 196 R, 196 CP, 196 AB, 41.31, 123/41.33, 41.86, 572; 184/6.13, 6.21, 6.22, 184/6.23, 104.1
See application file for complete search history.

(56) References Cited

U.S. PATENT DOCUMENTS

| | | | | |
|---|---|---|---|---|
| 3,606,935 | A * | 9/1971 | John | 184/6.1 |
| 4,258,676 | A * | 3/1981 | Lamm | 123/142.5 R |
| 4,815,431 | A * | 3/1989 | Yorita et al. | 123/196 AB |
| 6,978,756 | B2 | 12/2005 | Korenjak et al. | |
| 7,017,546 | B1 | 3/2006 | Patel et al. | |
| 2006/0102159 | A1 * | 5/2006 | Hommes | 123/572 |
| 2006/0102429 | A1 | 5/2006 | Suzuki et al. | |

FOREIGN PATENT DOCUMENTS

| | | | |
|---|---|---|---|
| DE | 509856 | C | 10/1930 |
| DE | 3731597 | A1 | 4/1988 |
| DE | 19961711 | A1 * | 7/2001 |
| DE | 10043801 | A1 | 3/2002 |
| DE | 10124509 | A1 | 11/2002 |
| DE | 10312902 | A1 | 9/2004 |
| DE | 102004013763 | A1 | 10/2005 |

OTHER PUBLICATIONS

German Search Report dated Feb. 8, 2010 in the corresponding German Patent Application No. 10 2009 000657.5 filed Feb. 6, 2009, pp. 1-4.

* cited by examiner

*Primary Examiner* — Noah Kamen
*Assistant Examiner* — Hung Q Nguyen
(74) *Attorney, Agent, or Firm* — Julia Voutyras; Brooks Kushman P.C.

(57) ABSTRACT

An internal combustion engine with a dry sump lubrication system is disclosed. The dry sump lubrication system has an oil pan coupled to the engine, an oil reservoir, an oil discharge tube coupling between the oil pan to the oil reservoir, an oil supply tube coupling the oil reservoir to the engine, and a vent tube coupling the oil reservoir to the intake manifold. The dry sump lubrication system may have a fresh air tube coupled to the oil reservoir. A control element coupled to an upstream side of the fresh air tube controls fresh air supplied to the oil reservoir. The oil reservoir may be insulated to retain energy in the oil during short shutdown periods. The oil reservoir may have a heat exchanger which allows engine coolant to flow through the heat exchanger.

18 Claims, 1 Drawing Sheet

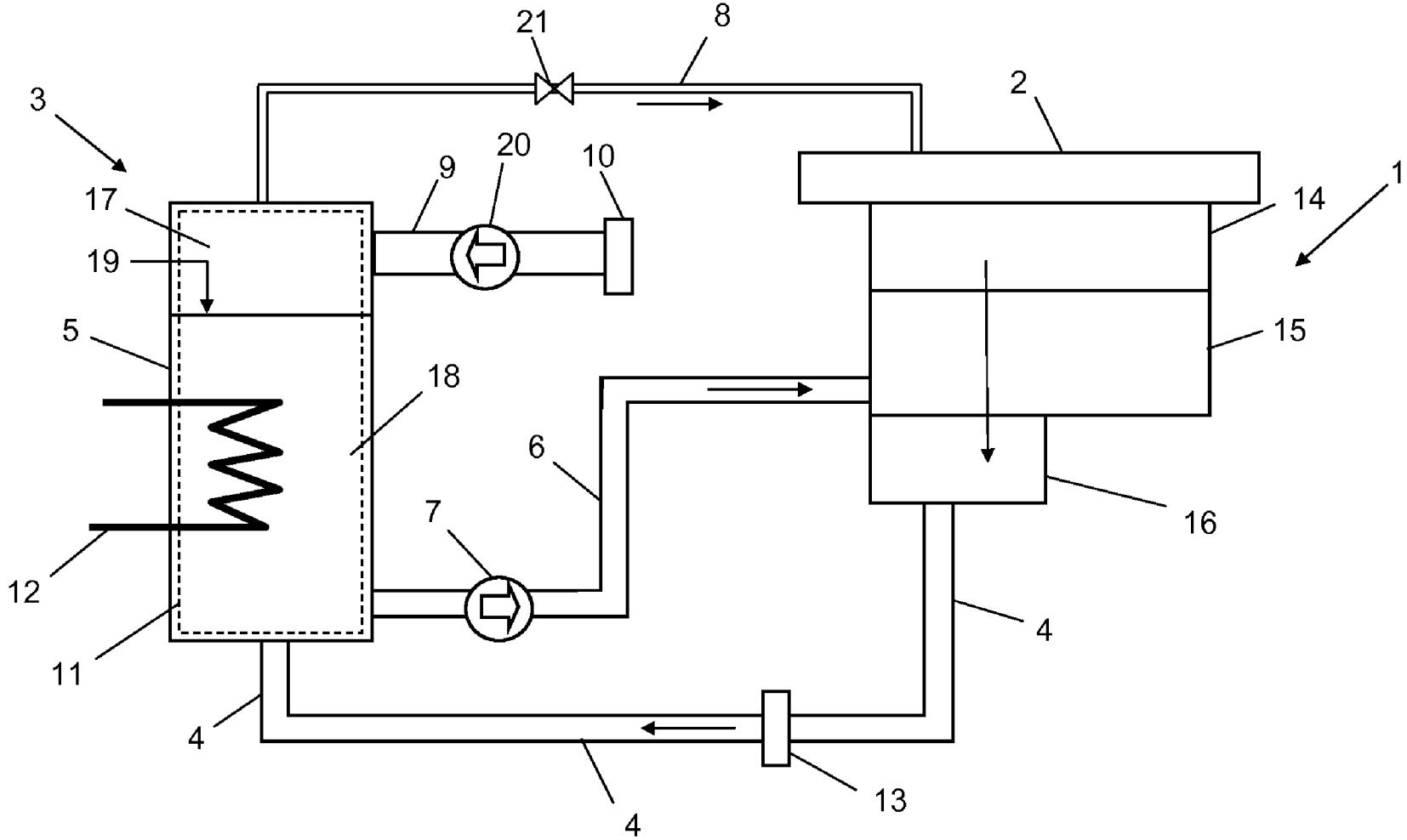
1
2
3
4
4
4
5
6
7
8
9
10
11
12
13
14
15
16
17
18
19
20
21

INTERNAL COMBUSTION ENGINE WITH DRY SUMP LUBRICATION

CROSS-REFERENCE TO RELATED APPLICATIONS

This application claims foreign priority benefits under 35 U.S.C. §119-(a)-(d) to DE 10 2009 000 657.5, filed Feb. 6, 2009, which is hereby incorporated by reference in its entirety.

BACKGROUND

1. Technical Field

A system and method for supplying oil to an internal combustion engine via a dry sump system is disclosed.

2. Background Art

In an internal combustion engine with dry sump lubrication, oil dripping from the internal combustion engine into the crankcase, is removed from the sump via an oil discharge tube into a separate oil reservoir located outside the internal combustion engine and is stored in this oil reservoir. Oil is supplied to the internal combustion engine from the oil reservoir via an oil supply tube with an oil pump in the oil supply tube.

A dry sump is a lubricating oil management system that uses a secondary external reservoir for oil, as compared to a conventional wet sump system in which the oil collects in an oil pan or oil pan. Because the oil reservoir is external with a dry sump system, the oil pan can be much smaller than a wet sump system, which allows lowering the engine. Also, dry sump systems are less susceptible to oil starvation problems that wet sump systems suffer if the oil sloshes in the oil pan, such as during a hard turn, on an incline, or during a hard acceleration, temporarily uncovering the oil pump pickup tube.

SUMMARY

An internal combustion engine with a dry sump lubrication system is disclosed. The dry sump lubrication system has an oil pan coupled to the engine, an oil reservoir, an oil discharge tube coupling the oil pan to the oil reservoir, an oil supply tube coupling the oil reservoir to the engine, and a vent tube coupling the oil reservoir to the intake manifold. The dry sump lubrication system may have a fresh air tube coupled to the oil reservoir. A control element coupled to an upstream side of the fresh air tube controls fresh air supplied to the oil reservoir. The oil reservoir may be insulated to retain energy in the oil during short shutdown periods.

The oil reservoir may have a heat exchanger which allows engine coolant to flow through the heat exchanger. When the engine oil temperature is below a predetermined temperature and the engine coolant is hotter than the engine oil, the heat exchanger is actuated to allow coolant flow to warm engine oil. When the engine oil temperature is above a maximum temperature and the engine coolant is cooler than the engine oil, the heat exchange is actuated to cool engine oil.

BRIEF DESCRIPTION OF THE DRAWING

FIG. 1 shows a schematic of an internal combustion with a dry sump lubrication system according to an embodiment of the disclosure.

DETAILED DESCRIPTION

As those of ordinary skill in the art will understand, various features of the embodiments illustrated and described with reference to the FIGURE may be combined with other features to produce alternative embodiments that are not explicitly illustrated and described. The combinations of features illustrated provide representative embodiments for typical applications. However, various combinations and modifications of the features consistent with the teachings of the present disclosure may be desired for particular applications or implementations. Those of ordinary skill in the art may recognize similar applications or implementations consistent with the present disclosure, e.g., ones in which components are arranged in a slightly different order than shown in the embodiments in the FIGURE. Those of ordinary skill in the art will recognize that the teachings of the present disclosure may be applied to other applications or implementations.

The internal combustion engine 1 is equipped with an intake manifold 2 for supplying fresh air. Engine 1 has a cylinder head 14 and a cylinder block 15. Oil drips into an oil pan 16, which is arranged below the cylinder block 15. Additionally, some of the gases in the combustion chambers of engine 1 leaks past piston rings and into the oil pan. Such flow is called blowby.

The oil dripping into oil pan 16 is conducted via an oil discharge tube 4 into an oil reservoir 5, with the oil in oil reservoir 5 denoted by numeral 18. To prevent backflow, a check valve 13 may be arranged in oil discharge tube 4. Oil 18 introduced into oil reservoir 5 has an oil level 19. Above oil 18 is gas 17 filling the remaining volume of oil reservoir 5.

Below oil level 19, an oil supply tube 6 branches off from the oil reservoir 5 to supply oil to internal combustion engine 1. To convey the oil, an oil pump 7 is arranged in oil supply tube 6.

A vent tube 8 branches from oil reservoir 5 above oil level 19. Vent tube 8 leads into a vacuum portion of intake manifold 2. Also coupled to oil reservoir 5 is a fresh air tube 9 also above oil level 19. Fresh air tube has a control element 10 arranged on its upstream end to control fresh air supply. If no fresh air were supplied into oil reservoir 5, gas 17 above oil 18 would consist largely of engine blowby gases. Engine blowby gases contain acidic components, water vapor, products of combustion including CO, NOx, as examples. These chemicals can react with oil 18 and cause degradation of the oil. To partially mitigate the degradation, fresh air is introduced into oil reservoir 5.

In some embodiments, oil reservoir 5 is provided with insulation 11. When a warm engine is stopped for a brief interval, oil 18 remains warm due to insulation 11. Subsequent operation of engine 1 with warm oil provides an improved startup using a lesser amount of fuel and reducing some emission constituents. In some embodiments, oil reservoir and is equipped with a heater 12. Insulation 11 is intended to delay the cooling of oil 18 located in the oil reservoir 5 during shut down; whereas, heater 12 actively heats oil 18.

In one embodiment heater 12 is an electric heater which is activated when temperature of oil 18 is determined to be less than a predetermined temperature. In another embodiment heater 12 is a heat exchanger through which engine coolant flows. When the temperature of oil 18 is less than engine coolant temperature and less than a predetermined temperature, flow through the heat exchanger is activated. With a heat exchanger, cooling of oil 18 is also possible. When the temperature of oil 18 is greater than engine coolant temperature and greater than a maximum temperature, flow through the heat exchanger is activated.

In embodiments in which there is no oil pump in oil discharge tube 4, flow from engine 1 to oil reservoir 5 is largely driven by the pressure difference between oil pan 16 and intake manifold 2. Pressure in oil reservoir 5 is also affected by control element 10.

Fresh air feed into the oil reservoir takes place for two reasons. The fresh air can be used to control the gas pressure in oil reservoir 5. If more fresh air is introduced into oil reservoir 5 than gas flows out of oil reservoir 5, pressure in oil reservoir 5 rises and the oil level falls. Conversely, if the fresh air quantity is smaller than the gas quantity discharged, pressure in the oil reservoir falls and the oil level rises.

In one embodiment, gas pressure in oil reservoir 5 is set primarily via the quantity of fresh air delivered to oil reservoir 5, as controlled by control element 10 in fresh air tube 9.

In another embodiment, pressure in oil reservoir is controlled by a valve 21 provided in vent tube 8.

In some embodiments, an air pump 20 is provided in fresh air tube 9 so that a pressure above ambient can be generated in oil reservoir 5. This can be used to assist in emptying oil reservoir 5 and/or to lower oil level 19.

While the best mode has been described in detail, those familiar with the art will recognize various alternative designs and embodiments within the scope of the following claims. Where one or more embodiments have been described as providing advantages or being preferred over other embodiments and/or over prior art in regard to one or more desired characteristics, one of ordinary skill in the art will recognize that compromises may be made among various features to achieve desired system attributes, which may depend on the specific application or implementation. These attributes include, but are not limited to: cost, strength, durability, life cycle cost, marketability, appearance, packaging, size, serviceability, weight, manufacturability, ease of assembly, etc. The embodiments described as being less desirable relative to other embodiments with respect to one or more characteristics are not outside the scope of the disclosure as claimed.

What is claimed:

1. An engine, comprising:
an intake manifold; and
a dry sump lubrication system comprising:
an oil pan coupled to the engine;
an oil reservoir;
an oil discharge tube coupling the oil pan to the oil reservoir;
an oil supply tube coupling the oil reservoir to the engine;
a vent tube coupling the oil reservoir to the intake manifold; and
a fresh air tube coupled to the oil reservoir and having a valve to control airflow therethrough.

2. The engine of claim 1 wherein the valve is coupled to an upstream side of the fresh air tube to control fresh air supplied to the oil reservoir.

3. The engine of claim 2 wherein the valve comprises an orifice which limits the amount of fresh air supplied through the fresh air tube to the oil reservoir.

4. The engine of claim 2 wherein the valve opens based on pressure in the oil reservoir.

5. The engine of claim 1 wherein the dry sump lubrication further comprises a check valve disposed in the oil discharge tube to prevent flow from the oil reservoir into the oil pan.

6. The engine of claim 1 wherein the oil reservoir is insulated.

7. The engine of claim 1 wherein the oil reservoir has a heat exchanger configured to allow engine coolant to flow through the heat exchanger thereby heating the oil when engine coolant is at a higher temperature than the oil and cooling the oil when engine coolant is at a lower temperature than the oil.

8. The engine of claim 1 wherein the oil reservoir has an electrical heater disposed therein.

9. The engine of claim 1 wherein the dry sump lubrication system further comprises an oil pump disposed in the oil supply tube.

10. A dry sump lubrication system for an internal combustion engine, comprising:
an oil pan coupled to the engine;
an oil reservoir remote from the engine;
an oil discharge tube coupled between the oil pan and the oil reservoir;
an oil supply tube coupled between the oil reservoir and the internal combustion engine;
a venting tube coupled between the oil reservoir and an intake manifold of the engine;
a fresh air tube coupled to the oil reservoir;
a control element coupled to an upstream side of the fresh air tube to control fresh air supplied to the oil reservoir; and
a heating element disposed within the oil reservoir.

11. The lubrication system of claim 10 wherein the heating element is an electrical heater and the electrical heater is activated when it is determined that oil should be at a higher temperature.

12. The lubrication system of claim 10 wherein the heating element is a heat exchanger configured to allow flow of engine coolant through the heat exchanger and the heat exchanger is activated when an oil temperature is lower than a coolant temperature and the oil temperature is lower than a predetermined minimum temperature.

13. The lubrication system of claim 10 wherein the heating element is a heat exchanger configured to allow flow of engine coolant through the heat exchanger and the heat exchanger is activated when an oil temperature is higher than a coolant temperature and the oil temperature exceeds a maximum temperature threshold.

14. The lubrication system of claim 10, further comprising: insulation on the oil reservoir.

15. A dry sump lubrication system for an internal combustion engine, comprising:
an oil pan coupled to the engine;
an oil reservoir remote from the engine;
an oil discharge tube coupled between the oil pan and the oil reservoir;
an oil supply tube coupled between the oil reservoir and the internal combustion engine;
a venting tube coupled between the oil reservoir and an intake manifold of the engine;
a fresh air tube coupled to the oil reservoir; and
a control element coupled to an upstream side of the fresh air tube to control fresh air supplied to the oil reservoir;
wherein the control element is selectively actuated to supply fresh air into the oil reservoir to change the pressure in the oil reservoir.

16. The lubrication system of claim 15 wherein the control element limits maximum flow of fresh air into the oil reservoir.

17. The lubrication system of claim 15 wherein the control element is selectively actuated so that the fresh air quantity fed to the oil reservoir is less than a gas quantity discharged from the oil reservoir into the vent tube to reduce the pressure in the oil reservoir.

18. The lubrication system of claim 15 wherein the control element is selectively actuated so that the fresh air quantity fed to the oil reservoir is greater than a gas quantity discharged from the oil reservoir into the vent tube thereby to increase the pressure in the oil reservoir.

* * * * *